US009474384B2

(12) United States Patent
Rawls-Meehan et al.

(10) Patent No.: US 9,474,384 B2
(45) Date of Patent: Oct. 25, 2016

(54) MATTRESS THERMAL MANAGEMENT SYSTEM

(71) Applicant: ASCION, LLC, Bloomfield Hills, MI (US)

(72) Inventors: Martin B. Rawls-Meehan, Franklin, MI (US); Jacob Michael Lalinsky, Dearborn, MI (US); Ronald Leong, East Amherst, NY (US); Andrew Z. Gong, Waterford, MI (US)

(73) Assignee: ASCION, LLC, Bloomfield Hills, MI (US)

( * ) Notice: Subject to any disclaimer, the term of this patent is extended or adjusted under 35 U.S.C. 154(b) by 0 days.

(21) Appl. No.: 14/702,355

(22) Filed: May 1, 2015

(65) Prior Publication Data

US 2015/0313370 A1 Nov. 5, 2015

Related U.S. Application Data

(60) Provisional application No. 61/987,974, filed on May 2, 2014.

(51) Int. Cl.

| | |
|---|---|
| ***A47C 21/04*** | (2006.01) |
| ***A47C 19/02*** | (2006.01) |
| ***A47C 27/14*** | (2006.01) |

(52) U.S. Cl.

CPC ..... *A47C 19/025* (2013.01); *A47C 21/04* (2013.01); *A47C 21/044* (2013.01); *A47C 21/048* (2013.01); *A47C 27/14* (2013.01)

(58) Field of Classification Search

CPC ..... A47C 21/04
USPC ..... 5/421–423, 724, 726, 652.1, 652.2, 704
See application file for complete search history.

(56) References Cited

U.S. PATENT DOCUMENTS

| | | | | |
|---|---|---|---|---|
| 3,266,064 | A * | 8/1966 | Murray | 5/726 |
| 3,486,177 | A * | 12/1969 | Marshack | 5/726 |
| 5,906,017 | A * | 5/1999 | Ferrand | A61G 7/00 5/613 |
| 6,546,576 | B1 * | 4/2003 | Lin | A47C 21/048 5/423 |
| 7,321,811 | B1 | 1/2008 | Rawls-Meehan | |
| 7,465,280 | B2 | 12/2008 | Rawls-Meehan | |
| 7,805,785 | B2 | 10/2010 | Rawls-Meehan | |
| 7,930,783 | B2 | 4/2011 | Rawls-Meehan | |
| 7,933,669 | B2 | 4/2011 | Rawls-Meehan | |
| 7,979,169 | B2 | 7/2011 | Rawls-Meehan | |
| 8,019,486 | B2 | 9/2011 | Rawls-Meehan | |
| 8,032,263 | B2 | 10/2011 | Rawls-Meehan | |
| 8,032,960 | B2 | 10/2011 | Rawls-Meehan | |
| 8,046,114 | B2 | 10/2011 | Rawls-Meehan | |
| 8,046,115 | B2 | 10/2011 | Rawls-Meehan | |
| 8,046,116 | B2 | 10/2011 | Rawls-Meehan | |
| 8,046,117 | B2 | 10/2011 | Rawls-Meehan | |

(Continued)

*Primary Examiner* — Fredrick Conley
(74) *Attorney, Agent, or Firm* — Marshall, Gerstein & Borun LLP

(57) ABSTRACT

The disclosure generally relates to a mattress thermal management system, for example a mattress cooling and/or heating system and in particular a suction- and/or discharge-based cooling and/or heating system. Deck-mounted fans beneath a mattress operate in various embodiments to induce a uniform suction flow, a uniform discharge flow, and/or a combined suction/discharge (circulating) flow that enhances the cooling and/or heating rate of the mattress. The mattress thermal management system can be incorporated into a conventional mattress/bed system or into an adjustable bed system.

26 Claims, 7 Drawing Sheets

(56) References Cited

U.S. PATENT DOCUMENTS

| | | | | |
|---|---|---|---|---|
| 8,050,805 | B2 | 11/2011 | Rawls-Meehan | |
| 8,069,512 | B2 | 12/2011 | Rawls-Meehan | |
| 8,078,336 | B2 | 12/2011 | Rawls-Meehan | |
| 8,078,337 | B2 | 12/2011 | Rawls-Meehan | |
| 8,150,562 | B2 | 4/2012 | Rawls-Meehan | |
| 8,375,488 | B2 | 2/2013 | Rawls-Meehan | |
| 8,565,934 | B2 | 10/2013 | Rawls-Meehan | |
| 8,682,457 | B2 | 3/2014 | Rawls-Meehan | |
| 2010/0011502 | A1* | 1/2010 | Brykalski et al. | 5/423 |

* cited by examiner

MATTRESS THERMAL MANAGEMENT SYSTEM

CROSS REFERENCE TO RELATED APPLICATION

Priority is claimed to U.S. Provisional Application No. 61/987,974 filed on May 2, 2014, which is incorporated by reference herein in its entirety.

STATEMENT OF GOVERNMENT INTEREST

None.

BACKGROUND OF THE DISCLOSURE

Field of the Disclosure

The disclosure generally relates to a mattress thermal management system, in particular a suction- and/or discharge-based cooling and/or heating system. Deck-mounted fans beneath a mattress operate in various embodiments to induce a uniform suction flow, a uniform discharge flow, and/or a combined suction/discharge (circulating) flow that enhances the cooling and/or heating rate of the mattress. The mattress thermal management system can be incorporated into a conventional mattress/bed system or into an adjustable bed system.

SUMMARY

In one aspect, the disclosure relates to a mattress support structure (e.g., bed frame) comprising: (a) a mattress support having a top surface for supporting a mattress and an opposing bottom surface (e.g., corresponding to the area beneath the bed/bed frame/mattress support structure); (b) a fan mounted to the mattress support and adapted to transport air (i) from above the top surface of the mattress support to below the bottom surface of the mattress support, (ii) from below the bottom surface of the mattress support to above the top surface of the mattress support, or (iii) both (i) and (ii) (e.g., (i) and (ii) can represent appropriately mounted uni-directional fans, (iii) can represent a bi-directional fan adapted to transport air in either direction); and optionally (c) an electromechanical system adapted to control one or more (e.g., a plurality of) moveable support platforms, wherein the fan is coupled to and controllable by the electromechanical system (e.g., PLC controller mounted to the bed frame or mattress support structure, such as directly to the mattress support or indirectly to the mattress support via lower frame structure; electromechanical system/PLC controller can receive fan operation instructions/commands from a remote control for the adjustable bed). In a refinement, the mattress support comprises an airflow channel between the top surface and the bottom surface to permit airflow therethrough; and the fan is mounted to the mattress support in fluid communication with the airflow channel. In a refinement, the mattress deck is a stationary structure (e.g., a unitary flat member for a fixed mattress support structure or a plurality of flat members collectively defining a flat mattress deck surface for a fixed mattress support structure). In a refinement, the mattress support is an adjustable bed comprising at least one moveable mattress support (e.g., further including an adjustable bed frame to which the mattress support is mounted, such as directly or indirectly). In a refinement, the mattress deck comprises a plurality of support platforms independently moveable relative to each other (e.g., a multi-section mattress deck for an adjustable mattress support structure; each support platform can have at least one fan mounted thereto). In a further refinement, the mattress support structure can comprise a plurality of fans mounted to the mattress support (or support platforms). In one embodiment, the fans are all mounted to the mattress support in a manner adapted to transport air from above the top surface of the mattress support to below the bottom surface of the mattress support (e.g., a mattress-side suction configuration). In another embodiment, the fans are all mounted to the mattress support in a manner adapted to transport air from below the bottom surface of the mattress support to above the top surface of the mattress support (e.g., a mattress-side discharge configuration). In another embodiment, the fans are all mounted to the mattress support in a manner adapted to transport air (i) from above the top surface of the mattress support to below the bottom surface of the mattress support, and (ii) from below the bottom surface of the mattress support to above the top surface of the mattress support. In another embodiment, at least some of the fans are mounted to the mattress support in a manner adapted to transport air from above the top surface of the mattress support to below the bottom surface of the mattress support; and at least some of the fans are mounted to the mattress support in a manner adapted to transport air from below the bottom surface of the mattress support to above the top surface of the mattress support (e.g., a combined mattress-side discharge and mattress-side suction configuration for circulation).

In another aspect, the disclosure relates to a mattress assembly system comprising: (a) the mattress support structure according to any of the variously disclosed embodiments; (b) a mattress positioned above the mattress support of the mattress support structure; and optionally (c) an airflow spacer positioned intermediate the mattress support structure and the mattress, the airflow spacer adapted to direct airflow (i) to the fans from the mattress, (ii) from the fans to the mattress, or (iii) both (i) and (ii) over substantially the entire area of the mattress. In one refinement, the mattress assembly system further comprises a remote control adapted to transmit fan operational commands to the fan and optionally further adapted to transmit bed repositioning commands to a corresponding adjustable bed frame (e.g., directly to a PLC controller for the fan or a combined PLC controller for the fan and adjustable bed; indirectly to a PLC controller for the fan via a separate PLC controller for the adjustable bed; controller(s) can be mounted on any bed structure, such as the mattress deck or (adjustable) bed frame). In another refinement, the mattress is a conventional mattress. In another refinement, the mattress comprises a mattress containment frame and a plurality of foam cells distributed throughout the containment frame to collectively define a mattress sleep surface. In a further refinement, the mattress further comprises at least one of (a) a plurality of vent holes on a base portion of the mattress containment frame, the vent holes being positioned to permit airflow through the mattress between interstitial areas defined by adjacent foam cells; and (b) a plurality of locator pins on a base portion of the mattress containment frame, wherein each locator pin (i) is adapted to mate with a corresponding open cylindrical channel in a foam cell, and (ii) comprises an open area permitting airflow through the mattress via the open area and the cylindrical channel. In another refinement, the mattress assembly further comprises at least one of a heating unit and a cooling unit mounted to the mattress assembly at a location beneath the mattress support bottom surface, the heating unit and the cooling unit being positioned to direct heated air and cooled air, respectively, to a fan suction side. In another refinement, the airflow spacer is a separate structure from the mattress and the mattress support. In another refinement, the airflow spacer is an integral component of the mattress. In another refinement, the mattress support comprises an airflow channel between the top surface and the bottom surface to permit airflow therethrough; the airflow spacer comprises an airflow channel positioned on a bottom surface of the airflow spacer and in a corresponding location to the airflow channel of the mattress support to permit airflow therethrough; and the fan is mounted to the mattress support in fluid communication with the airflow channel of the mattress support and the corresponding airflow channel of the airflow spacer.

In another aspect, the disclosure relates to a method for cooling or heating a mattress, the method comprising: (a) providing the according to any of the variously disclosed embodiments; (b) operating the fans of the mattress assembly to actively cool or heat the mattress of the mattress assembly (e.g., also cooling or heating the mattress while a user of the bed is sleeping or laying on the mattress). In a refinement, the method comprises operating the fans to actively cool the mattress with ambient environmental air (e.g., operating the fan or fans in a mattress-side suction, discharge, or recirculation flow). In another refinement, the method comprises operating the fans to actively cool the mattress with actively cooled air (e.g., operating the fan or fans in a mattress-side suction, discharge, or recirculation flow; using an integrated cooling unit with the mattress assembly beneath the mattress support; using a remote cooling unit adapted to direct cooled air relative to ambient beneath the mattress support). In another refinement, the method comprises operating the fans to actively heat the mattress with actively heated air (e.g., operating the fan or fans in a mattress-side suction, discharge, or recirculation flow; using an integrated heating unit with the mattress assembly beneath the mattress support; using a remote heating unit adapted to direct heated air relative to ambient beneath the mattress support).

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

While the disclosed apparatus and methods and are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

DETAILED DESCRIPTION

The disclosure generally relates to a mattress thermal management system, for example a mattress cooling system and in particular a suction-based cooling system. In other embodiments, the mattress thermal management system can operate as a mattress heating system. Deck-mounted fans beneath a mattress operate in various embodiments to induce a uniform suction flow or a combined suction/discharge (circulating) flow that enhances the cooling or heating rate of the mattress. Suitably, air is used as the fluid heat transfer medium, whether the system is operating for mattress cooling or heating. In other embodiments, a gaseous fluid other than air may be used as a fluid heat transfer medium circulated by the deck-mounted fans (e.g., alone or in combination with air). Accordingly, references in the following description to "air" and "airflow" apply as well to various other gaseous heat transfer fluids more generally. The mattress cooling system can be incorporated into a conventional mattress/bed system or into an adjustable bed system.

Figure 1:
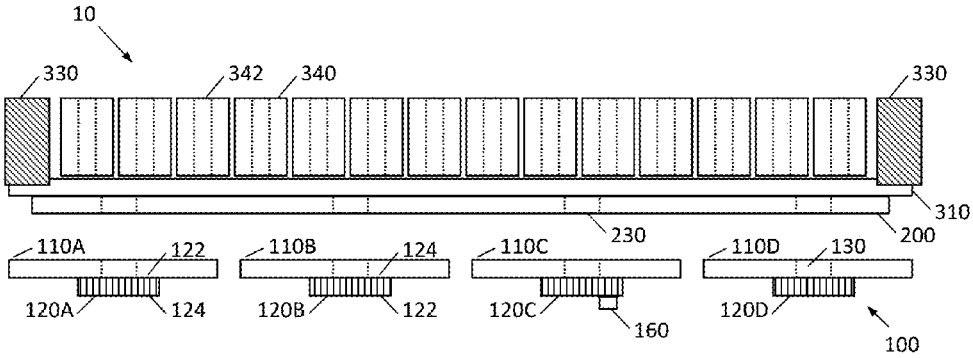
FIG. 1 is a side exploded view of a mattress thermal management system according to the disclosure.
Figure 2:
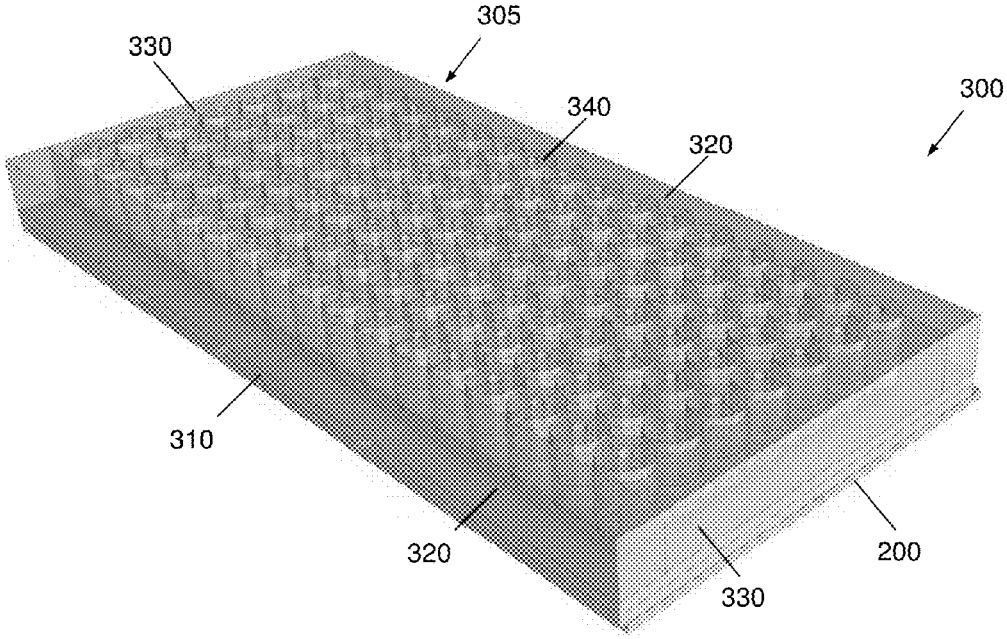
FIG. 2 is a top perspective illustration of a mattress and airflow spacer according to the disclosure.

FIG. 1 is a side exploded view of a mattress thermal management (e.g., cooling and/or heating) system 10 according to the disclosure. The illustrated mattress thermal management system 10 includes a mattress deck (or mattress support) 100, optionally an airflow spacer 200 positioned thereon, and a mattress 300 positioned above the mattress deck 100 (e.g., sitting upon the airflow spacer 200 when present or sitting directly on the mattress deck 100). FIG. 2 is a top perspective illustration of the mattress 300 according to a particular embodiment of the disclosure. More generally, the mattress thermal management system 10 and components thereof can be used with a fixed-frame bed or an adjustable-frame bed.

The mattress deck 100 includes a deck support platform 110, for example including a plurality of deck support platforms 110A-110D as illustrated. A single unitary deck support platform 110 is suitable for a conventional (non-adjustable) bed assembly. A deck support platform 110 formed from a plurality of deck support platforms 110A-110D is suitable for an adjustable bed assembly. In some embodiments the support platform(s) 110 can be formed from a rigid support material such as wood or metal. In other embodiments the support platform(s) can be formed from a flexible fabric or material. The deck support platform 110 includes a fan 120 (e.g., axial fan, centrifugal fan, cross-flow fan, or other means for blowing or otherwise transporting air or gaseous fluid) mounted thereto, for example plurality of fans 120A-120D as illustrated. While each deck support platform 110A-110D is illustrated as having a corresponding fan 120A-120D, each platform 110A-110D can have none, one, or more than one corresponding fans 120 mounted thereto. Each fan 120 is mounted to the deck 110 adjacent to, within, or otherwise in fluid communication with a corresponding airflow channel 130, thereby permitting airflow through the mattress 300, the airflow spacer 200 (when present), and the mattress deck (i.e., via the airflow channel 130 and the fan 120) in either direction.

Each fan 120 has a suction side 122 (i.e., a fan surface/plane across which air is drawn from the external environment into the fan interior) and a discharge side 124 (i.e., a fan surface/plane across which air is expelled from the fan interior to the external environment). As illustrated, the fan 120 can be mounted on its suction side 122 to the deck support platform 110, thereby creating a suction air flow during fan operation, drawing air through the mattress 300 and expelling the air beneath the deck support platform 110 to the external environment underneath the bed. As alternatively illustrated, the fan 120 can be mounted on its discharge side 124 to the deck support platform 110, thereby creating a discharge air flow during fan operation, drawing air from the external environment underneath the bed, through the deck support platform 110 and then through the mattress 300. In some embodiments, the fans 120A-120D are all mounted in the same suction/discharge orientation (e.g., all mounted on their suction sides 122 to the platform 110; all mounted on their discharge sides 124 to the platform 110). In other embodiments, the fans 120A-120D are mounted in a mixed suction/discharge orientation (e.g., some mounted on their suction sides 122 to the platform 110 and some mounted on their discharge sides 124 to the platform 110). In some embodiments, some or all of the fans 120A-120D are unidirectional fans (i.e., having fixed suction and discharge sides, being intended to transport air in a single direction). In some embodiments, some or all of the fans 120A-120D are bidirectional fans (i.e., having variable suction and discharge sides depending on impeller rotation, being capable of transporting air in two different (opposing) directions).

The airflow spacer 200 can be any type of structure that includes an open void volume permitting airflow therethrough and directing the airflow to improve the spatial distribution (e.g., uniformity thereof) of airflow through the mattress 300 (e.g., in particular when the fans 120A-120D are positioned at discrete, non-uniformly spaced locations in the deck support platform 110). Suitably, the airflow spacer 200 is a formed from a flexible material to accommodate a moveable deck support platform 110 of an adjustable bed. Suitable structure for the airflow spacer 200 includes a mesh fabric (e.g., three-dimensional fabric) or other porous material, a manifold structure, a duct structure, a channel structure, and a cavity structure. In some embodiments, the airflow spacer 200 is a separate structure from the mattress 300 and the mattress deck 100. In other embodiments, the airflow spacer 200 can be an integral component of the mattress deck 100 (e.g., with the platform(s) 110 thereof) or it can be an integral component of the mattress 300 (e.g., with the base 310 thereof).

The mattress 300 is not particularly limited, and it can be a conventional mattress 300 (e.g., a spring or coil mattress, memory foam mattress, air mattress) with a base 310 (e.g., a continuous fabric material) suitable for use on a mattress support structure such as a fixed bed frame or an adjustable bed frame. In the illustrated embodiment, the mattress 300 includes a mattress containment frame 305 including a plurality of foam cells (or foam springs) 340 positioned in the frame 305 to provide the sleeping support surface for the mattress. The mattress containment frame 305 includes a lower/bottom base 310, sidewalls 320, and endwalls 330 which generally define the interior frame 305 volume housing the foam cells 340. The sidewalls 320 and endwalls 330 suitably are formed from a foam material. The base 310 can be a generally continuous fabric material (e.g., a continuous surface but sufficiently thin and porous at a small scale to permit airflow therethrough between the mattress 300 and the airflow spacer 200, such as a fabric material). In some embodiments, the base 310 can include one or more larger open areas (e.g., airflow channels) to enhance the rate of airflow therethrough between the mattress 300 and the airflow spacer 200. The mattress 300 and optionally the airflow spacer 200 (e.g., as a separate or integral component of the mattress 300) are generally positioned above the mattress support 100, for example sitting directly atop the deck support sections 110A-110D.

Figure 3A:
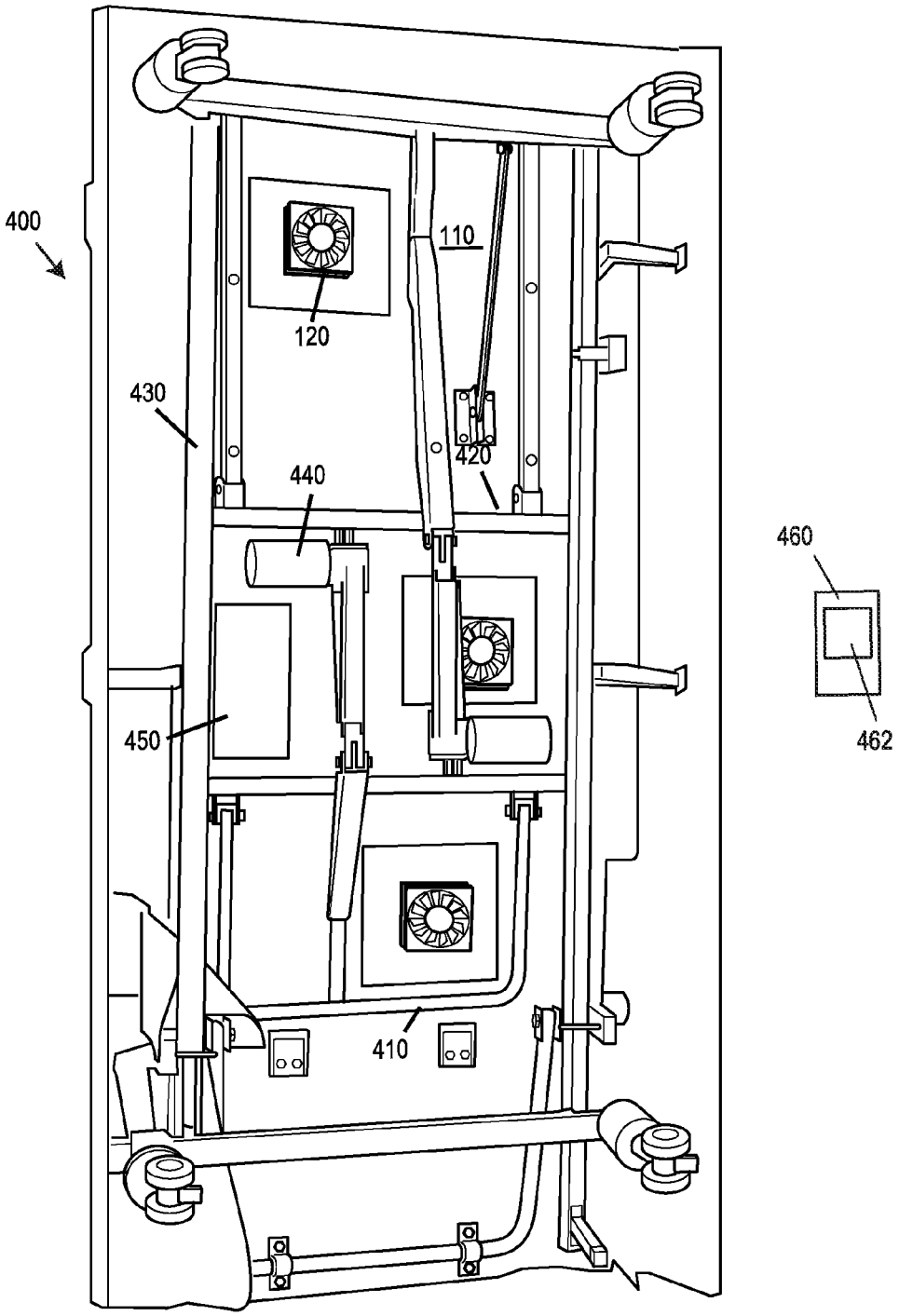
FIGS. 3*a* and 3*b* illustrate bottom views of a mattress deck and an associated adjustable bed frame according to the disclosure (3*a*: twin deck and bed frame; 3*b*: queen deck and bed frame).
Figure 3B:
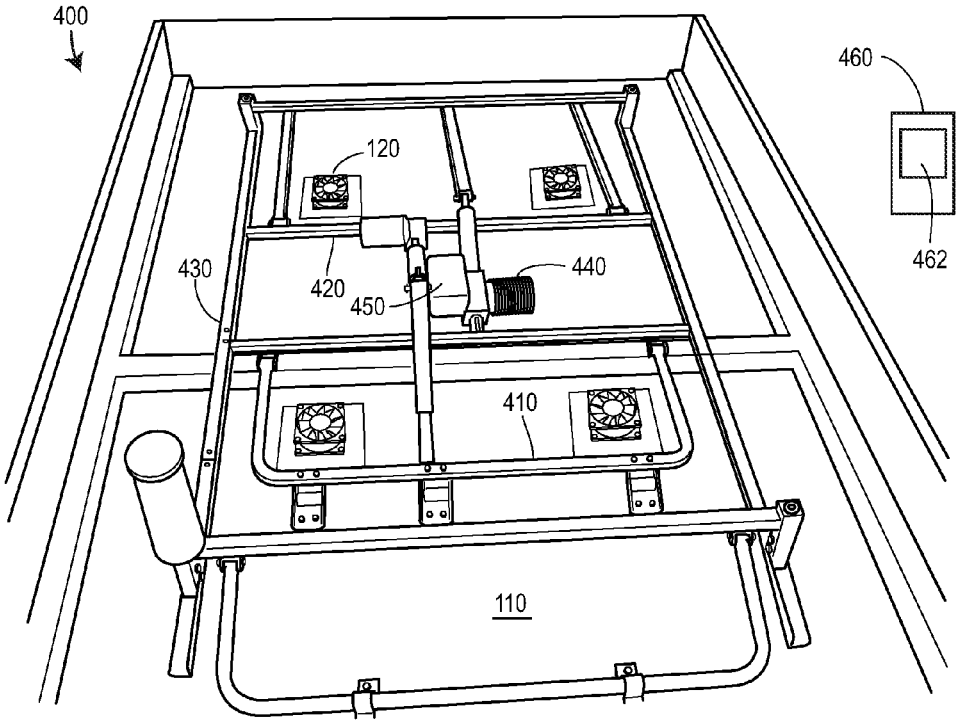

FIGS. 3*a* and 3*b* illustrate a bottom view of a mattress deck 100 and an associated adjustable bed frame 400 according to the disclosure (3*a*: twin deck and bed frame; 3*b*: queen deck and bed frame). The adjustable frame 400 generally provides the mechanical, electrical, and electronic support and articulation components for the mattress system 10 and mattress deck 100. As illustrated, the adjustable frame 400 includes a frame support 410. Each deck support section 110A-110D can be fixedly or removably mounted (e.g., via bolts, screws, or other fastener or adhesive components) to the underlying frame support 410 such that when one or more sections of the frame support section 410 are articulated, the deck support sections 110A-110D are correspondingly articulated. As illustrated, the adjustable frame 400 further includes a subframe 430, for example a rigid, non-articulatable frame structure which sits on a floor or within a decorative bed frame common in the furniture industry such as a platform bed (e.g., via various leg elements, not shown) and provides stability for the mattress system 10 as the adjustable frame 400 is articulated to various different positions. The adjustable frame 400 can further include one or more support members 420 connecting structure between the subframe 430 and the frame support 410. As further illustrated, the adjustable frame 400 can include one or more actuators 440 variously mounted to one or more of the subframe 430, a support member 420, and the frame support 410. In some embodiments, the subframe 430, the support members 420, and the frame support 410 can be formed from metal such as steel. The actuators 440 can be any of those commonly known in the art. The actuators 440 and, correspondingly, the configuration or position of the adjustable frame 400, mattress support 100, and mattress 300 can be controlled and adjusted by a suitable power supply 450, adjustable bed controller 450 (e.g., programmable logic controller or otherwise, which may be integrated with the power supply or separate structure), and a remote control 460 to deliver repositioning commands and/or thermal management system commands (e.g., fans/system on or off; fans/system in heating or cooling mode; fan/system intensity/speed). In some embodiments, a programmable timer may be incorporated into the adjustable bed controller 450, the remote control 460, or otherwise, thus allowing the fans 120 to be programmably operated in any desired heating and/or cooling mode at a user-specified fan intensity/speed, temperature set point, start time, a user-specified duration, and/or a user-specified end time.

In some embodiments, the controller 450 is a combined controller providing power and send/receive command/control functionality to both the adjustable bed frame 400 (e.g., repositioning commands, power to actuators 440, etc.) and the thermal management system 10 (e.g., thermal management commands, power to fans 120, etc.). In other embodiments, the controller 450 can include two separate controller structures: a first controller providing power and send/receive command/control functionality to the adjustable bed frame 400 and a second controller providing power and send/receive command/control functionality to the thermal management system 10. In such embodiments, the first and second controllers can be electronically connected (e.g., wired or wireless connection), for example in a master-slave arrangement. For example, the first controller can be a master controller capable of receiving commands from the remote 460 for both the adjustable bed frame 400 and the thermal management system 10, and then the first controller can pass commands for the thermal management system 10 to the second controller for execution. In other embodiments, each of the first and second controllers may be configured to independently receive and execute commands from the remote 460.

The remote control 460 is not particularly limited. In an embodiment, the remote 460 includes a touch screen 462 to receive user commands (e.g., regarding adjustable bed position, fan operation, heating/cooling modes, timing of same, etc.) and/or to display to the user the current status of the adjustable bed position and/or the thermal management system (e.g., reflecting confirmation of successfully executed commands as sensed and reported by the controller 450). In some embodiments, the remote 460 can be a wired unit connected to the controller 450, for example a dedicated remote 460 for the adjustable bed. In other embodiments, the remote 460 can include a wireless transceiver for communication (e.g., two-way communication) with a corresponding transceiver in the controller 450. Any suitable wireless communication protocol may be used to send commands from the remote 460 to the controller 450 (e.g., and optionally to receive feedback from the 450 confirming successful execution of the sent commands), for example including infrared (IR) and/or radio frequency (RF) (e.g., WIFI, BLUETOOTH, or otherwise) wireless protocols. In some embodiments, the wireless remote 460 can be communication matched with the controller 450, for example using a communication key or code key transmitted and received between the remote 460 and controller 450 to confirm that the controller 450 may receive and execute user commands from the remote 460 (e.g., further including a confirmation from the controller 450 to the remote 460 that the communication key or code key has been received and accepted). The wireless remote 460 can be a dedicated remote 460 for the adjustable bed. In other embodiments, the wireless remote 460 can be a mobile electronic device (e.g., cell phone, smart phone, tablet computer) running a software application providing a user interface for control of adjustable bed functions and/or thermal management system functions. The remote 460 also can implement various memory functions associated with the adjustable bed and/or thermal management system, for example using memory-stored settings related to the same in one or more of the remote 460, the controller 450, and a location separate from the remote 460 and the controller 450 (e.g., at a remote network location). Memory settings related to adjustable bed position, thermal management settings (e.g., fan speed, duration, start/stop time, temperature set point), or both can be stored in memory (e.g., based on a user indication to save one or more settings as presets for later recall) using the remote 460, and the memory settings can be recalled at a later time by the remote 460 as command for execution by the controller 450. In some embodiments, the memory setting can relate to a single setting (e.g., an adjustable bed position, a thermal management setting). In other embodiments, the memory setting can represent a global command relating to multiple settings (e.g., one or more adjustable bed positions for multiple bed segments, one or more thermal management settings, combinations thereof, etc.).

The thermal mattress system 10 can further include one or more temperature sensors 160 (e.g., a thermocouple or other suitable conventional means for sensing temperature). The sensor(s) 160 can be located at any desired location(s) in the mattress system, for example on the mattress deck 100, the airflow spacer 200, the mattress 300, and/or the adjustable bed frame 400. For example, the sensors(s) can be located on a fan 120 surface (e.g., as illustrated; such as on or near an intake or exhaust surface), a deck support 110 surface (e.g., bottom or top side thereof), an interior or exterior surface of the airflow spacer 200, an interior or exterior surface of the mattress 300 or a component thereof (e.g., base 310, sidewall 320, endwall 330, foam cylinder 340, top or bottom surface of mattress 300 as a whole). The temperature sensor(s) 160 can be coupled to the controller 450 (e.g., a component thereof for the thermal management system 10) for form a temperature feedback control loop for the thermal management system 10. Given a temperature set point (e.g., preset or selected by a user), the controller 450 can be programmed to monitor current temperature and adjust the thermal management system 10 settings based on the set point (e.g., increase or decrease heating or cooling such as by adjusting fan intensity/speed, fan operation duration, heating/cooling unit output temperature). In some embodiments, a user can enter a desired set point in terms of a user-sensible temperature (e.g., mattress upper surface temperature, ambient temperature above the mattress upper surface), and the controller 450 feedback control loop logic can be programmed to use the temperature actually sensed at a different location by the sensor 160 as a proxy for the set point (e.g., by specifying or determining a relationship between the desired set point and the sensed temperature).

Figure 4A:
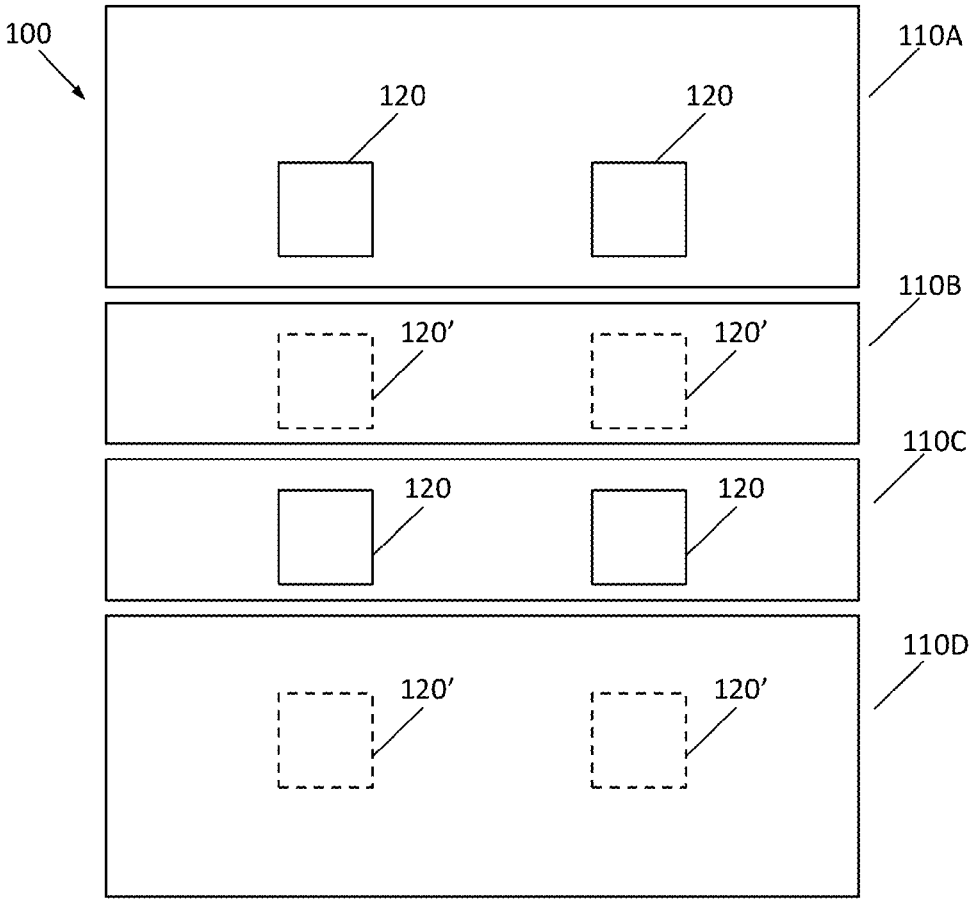
FIGS. 4*a* and 4*b* are schematics of the bottom side of the mattress deck of FIG. 3*b* showing possible placements of cooling fans.
Figure 4B:
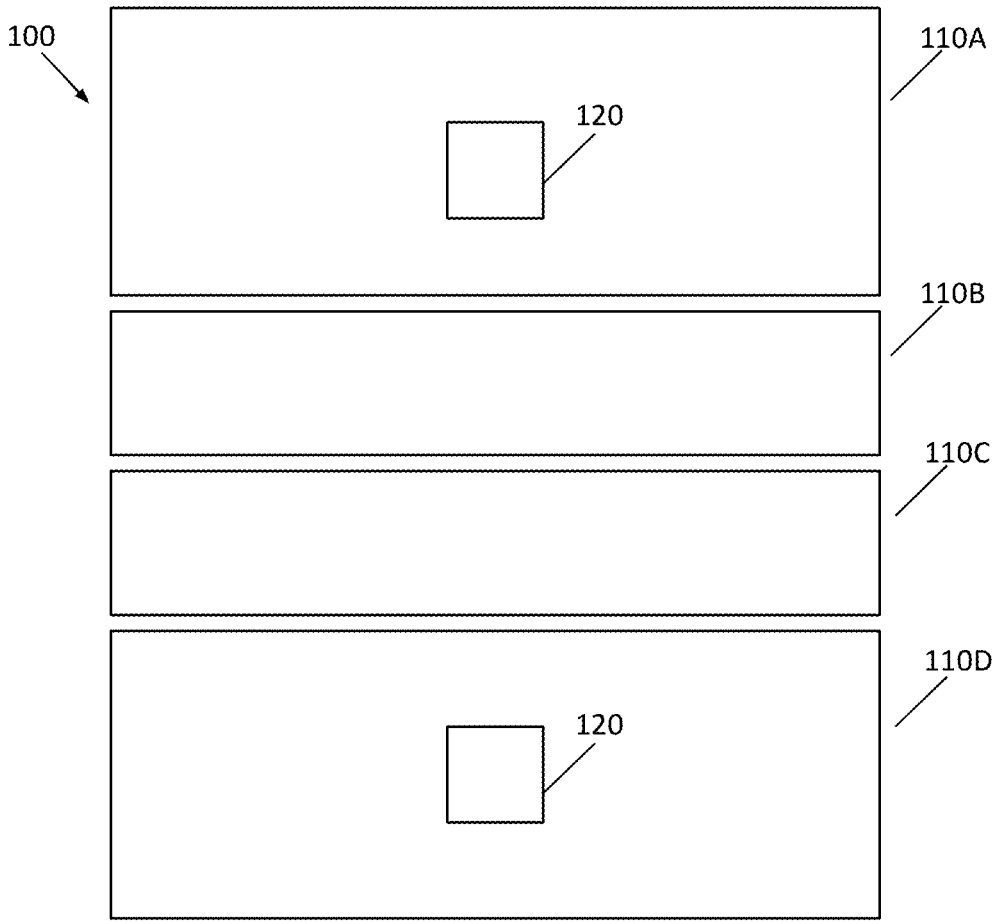

As shown, the fans 120 may be irregularly spaced/positioned on the underside of the mattress deck 100 to accommodate other mechanical and/or electronic bed components, in particular for the adjustable bed frame 200. The fans 120 can be powered and controlled by the electromechanical system of the adjustable bed (e.g., illustrated via the wires from fans to the power supply/programmable logic controller 450 (PLC), which can provide power to the fans 120 and can provide operating instructions to the fans 120, for example as received from an external remote control unit 460 for the adjustable bed). FIG. 4*a* is a schematic of the bottom side of the mattress deck 100 of FIG. 3*b* showing the placement of four cooling fans 120 as well as optional placement locations 120' for additional fans (e.g., if greater airflow is desired). FIG. 4*b* is is a schematic of the bottom side of the mattress deck 100 in alternative embodiment including one fan 120 in the head section 110A and one fan 120 in the foot section 110B of the mattress deck 100.

Figure 5:
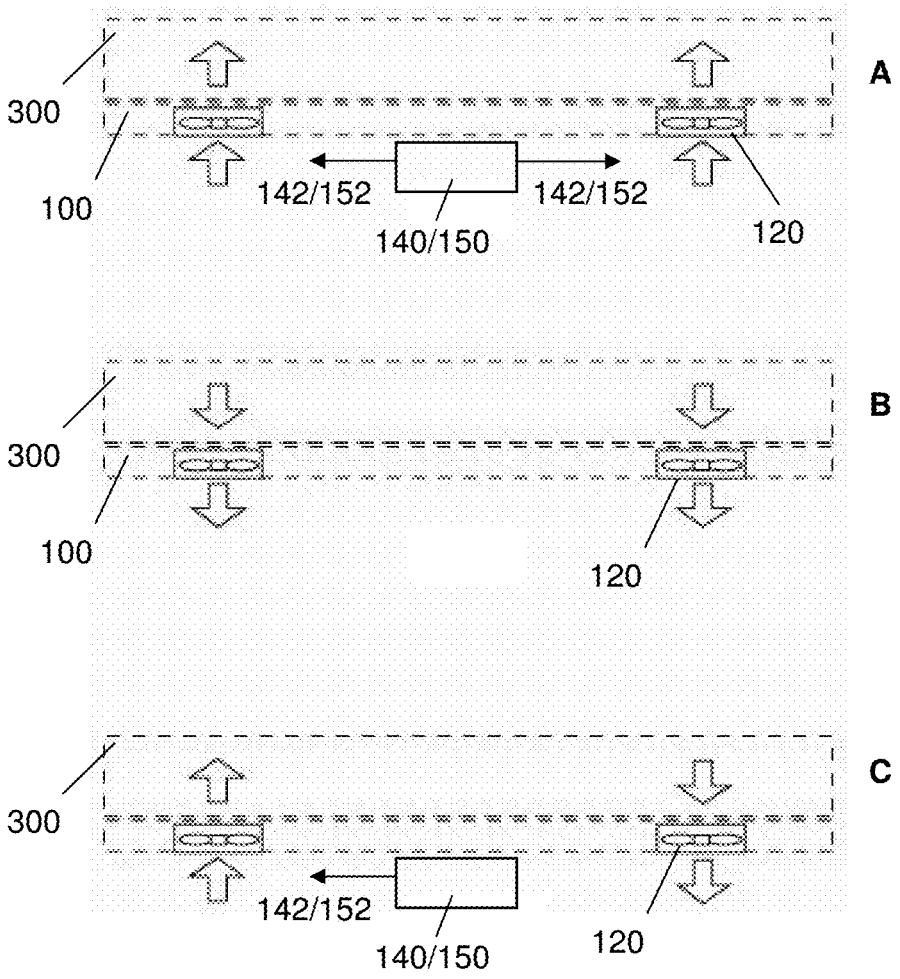
FIG. 5 is a side view of mattress thermal management system embodiments according to the disclosure (A: mattress-side airflow discharge; B: mattress-side airflow suction; C: mattress-side airflow combined discharge and suction).

FIG. 5 is a side view of mattress cooling system embodiments according to the disclosure (A: mattress-side airflow discharge; B: mattress-side airflow suction; C: mattress-side airflow combined discharge and suction). In FIG. 5A, both fans 120 are mounted (or otherwise operating in) a mattress-side discharge orientation in which airflow is transported from beneath the deck support platform 110 and up through the mattress 300. In FIG. 5B, both fans 120 are mounted (or otherwise operating in) a mattress-side suction orientation in which airflow is transported from above the mattress 300, through the mattress 300 and the deck support platform 110, and to the area beneath the deck support platform 110. In FIG. 5C, the fans 120 are alternatively mounted (or otherwise operating in) in a mattress-side suction orientation and a mattress-side discharge orientation, thereby creating a recirculating airflow pattern for enhanced cooling effectiveness. In any of the of the various fan 120 configurations and operating modes (e.g., mattress-side suction, discharge, or recirculation flow), the operation of the fans and be used to actively cool the mattress 300 with ambient environmental air, for example from either above the mattress 300, below the mattress deck 100, or both.

Other cooling embodiments for cooling the mattress 300 of the mattress system 10 are possible. For example, in the embodiments illustrated in FIGS. 5A and 5C, a cooler or cooling unit 150 may be positioned below the mattress deck 100 (e.g., mounted thereto and/or to mattress support structure therebelow such as the adjustable bed frame 400 or a component thereof), and the cooler 150 can be positioned to cool air 152 being fed upwards into the mattress 300 (e.g., by either fan 120 illustrated in FIG. 5A; by the left-illustrated fan 120 in FIG. 5C), thus actively cooling the mattress 300. In an embodiment, the cooler 150 can be a portable cooling or air conditioning unit 150 capable of cooled air relative to the ambient environment. Alternatively, the cooler 150 may be positioned remotely from the mattress deck 100 (or bed more generally) and the cooler 150 can direct cold air 152 from the remote location to the fans 120 for circulation through the mattress 300. The remote cooler 150 can be a portable cooling or air conditioning unit 150 spaced proximately to direct cold air 152 below the mattress deck 100 to be fed upwards into the mattress 300. In some embodiments, the remote cooler 150 can be an HVAC (heating, ventilation, air conditioning) system or a component thereof, such as a home HVAC system configured to direct cold air 152 below the mattress deck 100 to be fed upwards into the mattress 300. In embodiments including a cooler 150, the mattress system 10 may be independently operated at the discretion of the user in a cooling mode using ambient environmental air (e.g., as described above without the cooler 150 being active) or a cooling mode using the cold air 152 from the cooler 150 to cool the mattress 300.

In some embodiments, the mattress system 10 can be adapted to heating the mattress 300 instead of cooling. For example, in the embodiments illustrated in FIGS. 5A and 5C, a heater or heating unit 140 may be positioned below the mattress deck 100 (e.g., mounted thereto and/or to mattress support structure therebelow such as the adjustable bed frame 400 or a component thereof), and the heater 140 can be positioned to heat air 142 being fed upwards into the mattress 300 (e.g., by either fan 120 illustrated in FIG. 5A; by the left-illustrated fan 120 in FIG. 5C), thus actively heating the mattress 300. In an embodiment, the heater 140 can be a portable heating unit 140 such as an electrically powered semiconductor-based micro thermal module capable of providing radiant heat relative to the ambient environment. Alternatively, the heater 140 may be positioned remotely from the mattress deck 100 (or bed more generally) and the heater 140 can direct hot air 142 from the remote location to the fans 120 for circulation through the mattress 300. The remote heater 140 can be a portable heating unit 140 spaced proximately to direct hot air 142 below the mattress deck 100 to be fed upwards into the mattress 300. In some embodiments, the remote heater 140 can be an HVAC system or a component thereof (e.g., where the same HVAC system is capable of providing cool air for cooling as above or hot air for heating), such as a home HVAC system configured to direct hot air 142 below the mattress deck 100 to be fed upwards into the mattress 300. In embodiments including a heater 140, the mattress system 10 may be independently operated at the discretion of the user in either a cooling mode (e.g., as described above without the heater 140 being active) or in a heating mode (e.g., with the heater 140 actively supplying heat to the airflow entering the mattress 300).

Figure 6:
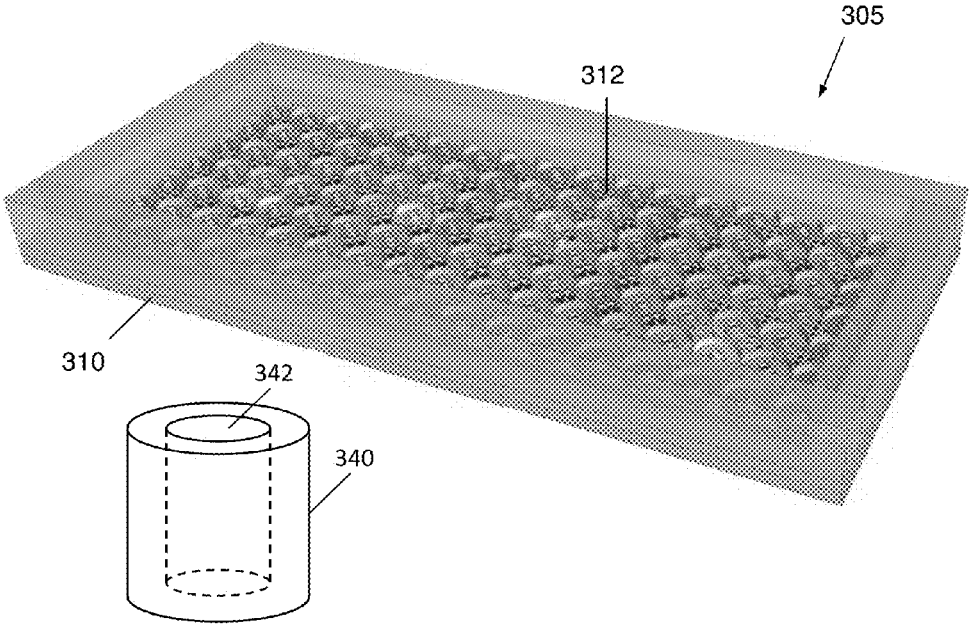
FIG. 6 is a top perspective illustration of a mattress containment frame according to the disclosure.
Figure 7:
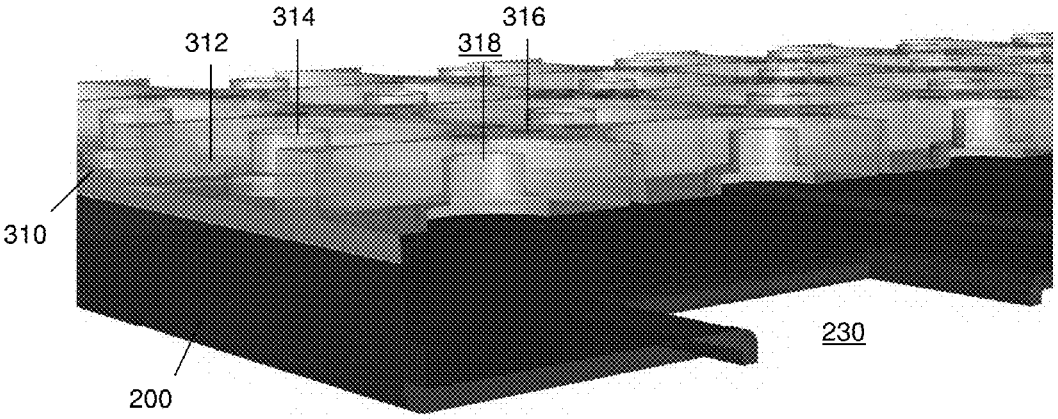
FIG. 7 is a side cut-away view of the mattress containment frame of FIG. 6 and a corresponding airflow spacer according to the disclosure.

FIG. 6 is a top perspective illustration of a mattress containment frame 305 according to the disclosure, and FIG. 7 is a side cut-away view of the mattress containment frame 305 and a corresponding airflow spacer 200 according to the disclosure. In an embodiment, the base 310 of the frame 305 can include a plurality of locator recesses 312 that are size and shaped (e.g., cylindrical as shown) to accommodate and seat corresponding foam cells 340. Each locator recess 312 includes a locator pin (or protrusion) 314 that mates with the corresponding open cylindrical channel 342 of a foam cell 340. The locator pin 314 has an open top area 318 to permit airflow through the open cylindrical channel of the foam cell 340, through the open top area of the locator pin 314, and then into the airflow spacer 200. As further illustrated, the base 310 includes a plurality of vent holes 316 positioned to permit airflow through the interstitial areas between adjacent foam cells 340 and the airflow spacer 200. The locator pin 314 open areas and vent holes 316 permit air circulation within the mattress 300, thereby enhancing the cooling effect of the fans 120. In the illustrated embodiment of FIG. 7, the airflow spacer 200 has an open channel-type structure and it further includes an open airflow channel area (or hole) 230 that generally corresponds to a similarly positioned airflow channel 130 in the deck support platform 110. In other mattress embodiments, airflow channels/structures through the thickness of the mattress 300 can be incorporated into a conventional mattress 300 as desired, thereby providing an airflow path for cooling and/or heating airflow paths between the top and bottom of the mattress 300 (e.g., similar to those provided by the vent holes 316 and open areas 318 in the illustrated embodiment), for example also in fluid communication with the open airflow channel area (or hole) 230 (e.g., in the bottom of the airflow spacer 200) and the airflow channel 130 in the mattress deck support 110.

Rawls-Meehan U.S. Pat. Nos. 7,321,811, 7,465,280, 7,805,785, 7,930,783, 7,933,669, 7,979,169, 8,019,486, 8,032,263, 8,032,960, 8,046,114, 8,046,115, 8,046,116, 8,046,117, 8,050,805, 8,069,512, 8,078,336, 8,078,337, 8,150,562, 8,375,488, 8,565,934, and 8,682,457 are incorporated herein by reference in their entireties and variously disclose mattresses including foam springs or foam cells and materials/configurations therefor, adjustable bed assemblies including adjustable mattress frames, electrical, mechanical, and electronic components associated therewith, and remote controls for use therewith, all of which may be used individually or collectively in combination with the mattress cooling system described herein.

EXAMPLES

The following examples illustrate the disclosed compositions and methods, but they are not intended to limit the scope of any claims thereto.

The queen bed illustrated in FIG. 3*b* and FIG. 4*a* was tested for its ability to cool a heated mattress, including a conventional mattress and a foam cell mattress as illustrated in FIG. 2. An electrical heating pad was used to heat the mattress for a fixed period (about 15 minutes), then the heating pad was removed, and then the mattress was allowed to cool with the fans operating to enhance cooling. The fans, which were operating in a mattress-side suction orientation (e.g., as illustrated in FIG. 5B), were effective at cooling the mattress and returning it to an ambient environmental temperature over a period of about 4 to 8 minutes.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the compositions, processes, or apparatus are described as including components, steps, or materials, it is contemplated that the compositions, processes, or apparatus can also comprise, consist essentially of, or consist of, any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

PARTS LIST

10 mattress system (cooling or heating)
100 mattress deck or support
110 deck support platform (sections 110A-D)
120 fan or means for blowing/transporting air (fans 120A-D)
122 suction side of fan
124 discharge side of fan
130 air flow channel
140 heating unit
142 heated air
150 cooling unit
152 cooled air
160 temperature sensor
200 airflow spacer
230 airflow channel
300 mattress
305 containment frame
310 base
312 locator recess
314 locator pin
316 vent hole
318 open top area
320 sidewalls
330 endwalls
340 foam cells or foam springs
342 cylindrical channel
400 adjustable bed frame
410 frame support
420 support member
430 subframe
440 actuator
450 power supply
460 remote control
462 touch screen

What is claimed is:

1. A mattress assembly system comprising:

(a) a mattress support comprising: (i) a mattress support having a top surface for supporting a mattress and an opposing bottom surface, and (ii) a fan mounted to the mattress support and adapted to transport air (A) from above the top surface of the mattress support to below the bottom surface of the mattress support, (B) from below the bottom surface of the mattress support to above the top surface of the mattress support, or (C) both (A) and (B); and (b) a mattress positioned above the mattress support of the mattress support structure;

wherein the mattress comprises a mattress containment frame and a plurality of foam cells distributed throughout the containment frame to collectively define a mattress sleep surface; and wherein the mattress further comprises at least one of a plurality of vent holes on a base portion of the mattress containment frame, the vent holes being positioned to permit airflow through the mattress between interstitial areas defined by adjacent foam cells; and a plurality of locator pins on a base portion of the mattress containment frame, wherein each locator pin (i) is adapted to mate with a corresponding open cylindrical channel in a foam cell, and (ii) comprises an open area permitting airflow through the mattress via the open area and the cylindrical channel.

2. A mattress support structure comprising:

(a) an adjustable bed frame comprising at least one moveable mattress support having a moveable top surface for supporting a mattress and an opposing moveable bottom surface, the mattress support comprising an airflow channel between the moveable top surface and the moveable bottom surface to permit airflow therethrough; and (b) a fan mounted to the moveable mattress support adjacent to the moveable bottom surface or within the airflow channel, the fan being in fluid communication with the airflow channel and adapted to transport air through the airflow channel (i) from above the top surface of the mattress support to below the bottom surface of the mattress support, (ii) from below the bottom surface of the mattress support to above the top surface of the mattress support, or (iii) both (i) and (ii).

3. A mattress support structure, comprising:

the mattress support structure of claim 2; and a mattress positioned above the moveable mattress support of the mattress support structure, the mattress comprising a mattress containment frame and a plurality of foam cells distributed throughout the containment frame to collectively define a mattress sleep surface and interstitial areas between adjacent foam cells.

4. The mattress support structure of claim 2, further comprising:

(c) an electromechanical system adapted to control the at least one moveable mattress support, wherein the fan is coupled to and controllable by the electromechanical system.

5. The mattress support structure of claim 4, further comprising an actuator mounted to the adjustable bed frame and adapted to move the moveable mattress support, wherein the actuator is coupled to and controllable by the electromechanical system.

6. The mattress support structure of claim 2, wherein the mattress support comprises a rigid mattress deck.

7. The mattress support structure of claim 2, wherein the mattress support comprises a flexible support material.

8. The mattress support structure of claim 2, wherein the moveable mattress support comprises a plurality of mattress support platforms, the mattress support structure comprises a plurality of fans mounted to the mattress support platforms, and at least two of the fans are on different mattress support platforms.

9. The mattress support structure of claim 8, wherein the fans are all mounted to the mattress support platforms in a manner adapted to transport air from above the top surface of the mattress support to below the bottom surface of the mattress support.

10. The mattress support structure of claim 8, wherein the fans are all mounted to the mattress support platforms in a manner adapted to transport air from below the bottom surface of the mattress support to above the top surface of the mattress support.

11. The mattress support structure of claim 8, wherein the fans are all mounted to the mattress support platforms in a manner adapted to transport air (i) from above the top surface of the mattress support to below the bottom surface of the mattress support, and (ii) from below the bottom surface of the mattress support to above the top surface of the mattress support.

12. The mattress support structure of claim 8, wherein:

at least some of the fans are mounted to the mattress support platforms in a manner adapted to transport air from above the top surface of the mattress support to below the bottom surface of the mattress support; and at least some of the fans are mounted to the mattress support platforms in a manner adapted to transport air from below the bottom surface of the mattress support to above the top surface of the mattress support.

13. A mattress assembly system comprising:

(a) the mattress support structure of claim 2; and (b) a mattress positioned above the mattress support of the mattress support structure.

14. The mattress assembly of claim 13, further comprising a remote control adapted to transmit fan operational commands to the fan.

15. The mattress assembly of claim 13, wherein the mattress is a conventional mattress.

16. The mattress assembly of claim 13, wherein the mattress comprises a mattress containment frame and a plurality of foam cells distributed throughout the containment frame to collectively define a mattress sleep surface.

17. The mattress assembly of claim 13, further comprising at least one of a heating unit and a cooling unit mounted to the mattress assembly at a location beneath the mattress support bottom surface, the heating unit and the cooling unit being positioned to direct heated air and cooled air, respectively, to a fan suction side.

18. The mattress assembly of claim 13, further comprising:

(c) an airflow spacer positioned intermediate the mattress support structure and the mattress, the airflow spacer adapted to direct airflow (i) to the fans from the mattress, (ii) from the fans to the mattress, or (iii) both (i) and (ii) over substantially the entire area of the mattress.

19. The mattress assembly of claim 18, wherein:

the mattress support comprises an airflow channel between the top surface and the bottom surface to permit airflow therethrough;

the airflow spacer comprises an airflow channel positioned on a bottom surface of the airflow spacer and in a corresponding location to the airflow channel of the mattress support to permit airflow therethrough; and the fan is mounted to the mattress support in fluid communication with the airflow channel of the mattress support and the corresponding airflow channel of the airflow spacer.

20. The mattress assembly of claim 18, wherein the airflow spacer is a separate structure from the mattress and the mattress support.

21. The mattress assembly of claim 18, wherein the airflow spacer is an integral component of the mattress.

22. A method for cooling or heating a mattress, the method comprising:

(a) providing the mattress assembly of claim 13;

(b) operating the fans of the mattress assembly to actively cool or heat the mattress of the mattress assembly.

23. The method of claim 22, comprising operating the fans to actively heat the mattress with actively heated air.

24. The method of claim 22, comprising operating the fans to actively cool or heat the mattress in part (b) while a user is sleeping or laying on the mattress.

25. The method of claim 22, comprising operating the fans to actively cool the mattress with ambient environmental air.

26. The method of claim 22, comprising operating the fans to actively cool the mattress with actively cooled air.

* * * * *